US012180954B2

(12) United States Patent
Okaguchi

(10) Patent No.: US 12,180,954 B2
(45) Date of Patent: Dec. 31, 2024

(54) PIEZOELECTRIC PUMP CASING AND SPACE ARRANGEMENT

(71) Applicant: Murata Manufacturing Co., Ltd., Kyoto (JP)

(72) Inventor: Kenjiro Okaguchi, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 78 days.

(21) Appl. No.: 17/504,681

(22) Filed: Oct. 19, 2021

(65) Prior Publication Data

US 2022/0056900 A1 Feb. 24, 2022

Related U.S. Application Data

(63) Continuation of application No. PCT/JP2020/014623, filed on Mar. 30, 2020.

(30) Foreign Application Priority Data

Jun. 27, 2019 (JP) ..... 2019-119299

(51) Int. Cl.
*F04B 43/04* (2006.01)
*F04B 23/04* (2006.01)
*F04B 53/16* (2006.01)

(52) U.S. Cl.
CPC ..... *F04B 43/046* (2013.01); *F04B 23/04* (2013.01); *F04B 53/16* (2013.01)

(58) Field of Classification Search
CPC ..... F04B 43/046; F04B 23/04; F04B 53/16; F04B 39/121
See application file for complete search history.

(56) References Cited

U.S. PATENT DOCUMENTS 4,648,807 A * 3/1987 Tippetts ..... F04B 43/046 417/524
11,204,027 B2 12/2021 Mou et al.
(Continued)

FOREIGN PATENT DOCUMENTS

CN 102597520 A 7/2012
DE 102018120782 B3 8/2019
(Continued)

OTHER PUBLICATIONS

International Search Report for International Patent Application No. PCT/JP2020/014623 dated Jun. 16, 2020.
(Continued)

*Primary Examiner* — Nathan C Zollinger
(74) *Attorney, Agent, or Firm* — Pearne & Gordon LLP

(57) ABSTRACT

A pump device (1) includes a piezoelectric pump (10) and an outer casing (70). The piezoelectric pump (10) includes a pump casing having inlets (400) and an outlet (520), a vibration plate (31) disposed inside the pump casing and dividing an internal space (500) of the pump casing into a first space (501) on a side near the inlets (400) and a second space (502) on a side near the outlet, and a piezoelectric element (20) disposed on the vibration plate (31). The outer casing (70) forms a flow path composed of an internal space (700) that allows communication between an external inlet (701), which communicates with the outside, and the inlets (400). The flow path has a part that is parallel to an outer main surface (40*op*) of the pump casing in which the inlets (400) are formed, the part being located outside the outer main surface (40*op*).

24 Claims, 12 Drawing Sheets

(56) References Cited

U.S. PATENT DOCUMENTS

| | | | | |
|---|---|---|---|---|
| 2008/0095651 | A1* | 4/2008 | Onishi | F04B 53/1065 417/558 |
| 2012/0171062 | A1 | 7/2012 | Kodama et al. | |
| 2015/0150470 | A1 | 6/2015 | Sano et al. | |
| 2017/0058882 | A1 | 3/2017 | Hirata et al. | |
| 2018/0066650 | A1 | 3/2018 | Fujisaki et al. | |
| 2019/0085839 | A1* | 3/2019 | Mou | F04B 39/10 |
| 2021/0199106 | A1 | 7/2021 | Bartels et al. | |
| 2021/0324851 | A1* | 10/2021 | Yamanaka | F04B 53/16 |

FOREIGN PATENT DOCUMENTS

| | | | | | |
|---|---|---|---|---|---|
| DE | 112013002723 | B4 | | 9/2021 | |
| EP | 2557312 | A1 | | 2/2013 | |
| EP | 3109472 | A1 | | 12/2016 | |
| EP | 4234930 | A2 | | 8/2023 | |
| JP | S6178287 | U | * | 5/1986 | |
| JP | 07224763 | A | * | 8/1995 | |
| JP | 2000287468 | A | * | 10/2000 | |
| JP | 2013-245649 | A | | 12/2013 | |
| JP | 2016-053371 | A | | 4/2016 | |
| JP | 2019-052644 | A | | 4/2019 | |
| WO | WO-2011145544 | A1 | * | 11/2011 | F04B 19/006 |
| WO | 2015/125843 | A1 | | 8/2015 | |
| WO | 2016/175185 | A1 | | 11/2016 | |

OTHER PUBLICATIONS

Written Opinion for International Patent Application No. PCT/JP2020/014623 dated Jun. 16, 2020.

* cited by examiner

PIEZOELECTRIC PUMP CASING AND SPACE ARRANGEMENT

CROSS REFERENCE TO RELATED APPLICATIONS

This is a continuation of International Application No. PCT/JP2020/014623 filed on Mar. 30, 2020 which claims priority from Japanese Patent Application No. 2019-119299 filed on Jun. 27, 2019. The contents of these applications are incorporated herein by reference in their entireties.

BACKGROUND OF THE DISCLOSURE

Field of the Disclosure

The present disclosure relates to a pump device that includes a piezoelectric pump that transports a fluid by making a vibration plate vibrate using a piezoelectric element.

Description of the Related Art

Patent Document 1 discloses a pump that uses a piezoelectric element. The pump includes a pump casing and a vibration plate. The pump casing has a pump chamber thereinside. The vibration plate is disposed in the pump chamber. Here, the vibration plate is supported by the pump casing so as to be able to vibrate.

The vibration plate divides the pump chamber into a first pump chamber and a second pump chamber. The first pump chamber communicates with the space outside the pump casing via an inlet formed in the pump casing. The second pump chamber communicates with the space outside the pump casing via an outlet formed in the pump casing.

The pump sucks a fluid such as air from the outside of the pump casing into the inside of the pump chamber via the inlet and expels the fluid inside the pump chamber to outside the pump casing via the outlet by utilizing vibrations of the vibration plate.

Patent Document 1: International Publication No. 2016/175185

BRIEF SUMMARY OF THE DISCLOSURE

However, the pump disclosed in Patent Document 1 generates heat due to the vibration of the vibration plate. In addition, when the temperature of the pump containing the vibration plate becomes high, a problem may occur in the operation of the pump.

Therefore, an object of the present disclosure is to provide a pump device having high heat dissipation performance.

A pump device of the present disclosure includes a piezoelectric pump and an outer casing. The piezoelectric pump includes a pump casing that has an inlet and an outlet, a vibration plate that is disposed inside the pump casing and divides a space inside the pump casing into a first space on a side near the inlet and a second space on a side near the outlet, and a piezoelectric element that is disposed on the vibration plate. The outer casing forms a flow path that allows communication between an external inlet, which communicates with the outside, and the inlet. A first main surface of the outer casing faces an outer main surface of the pump casing in which the inlet is formed. The flow path is located at least between the outer main surface of the pump casing and the first main surface of the outer casing.

With this configuration, the heat generated by the piezoelectric pump and transmitted to an outer main surface of a wall of the pump casing in which the inlet is formed is cooled by a fluid flowing along the flow path. Since the fluid is at a low temperature prior to being sucked into the piezoelectric pump and the area of the outer main surface of the wall in which the inlet is formed is large, the cooling effect on the heat of the piezoelectric pump is high.

According to the present disclosure, the heat dissipation performance of a pump can be improved.

DETAILED DESCRIPTION OF THE DISCLOSURE

First Embodiment

Figure 1A:
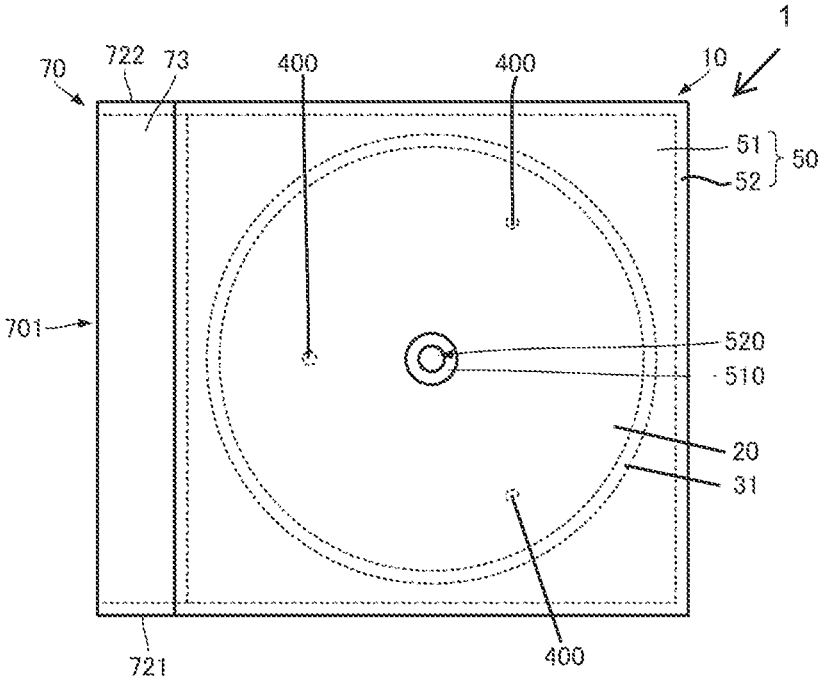
FIG. 1A is a plan view of a pump device according to a First Embodiment.
Figure 1B:
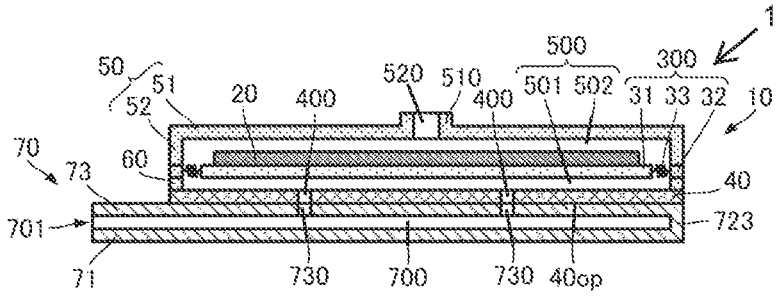
FIG. 1B is a lateral plane sectional view illustrating the configuration of the pump device according to the First Embodiment.
Figure 1C:
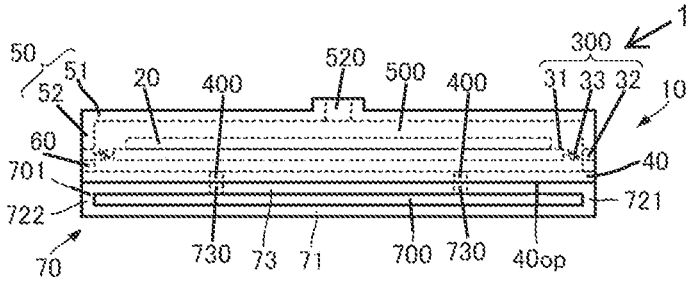
FIG. 1C is a side view of the pump device according to the First Embodiment.
Figure 2:
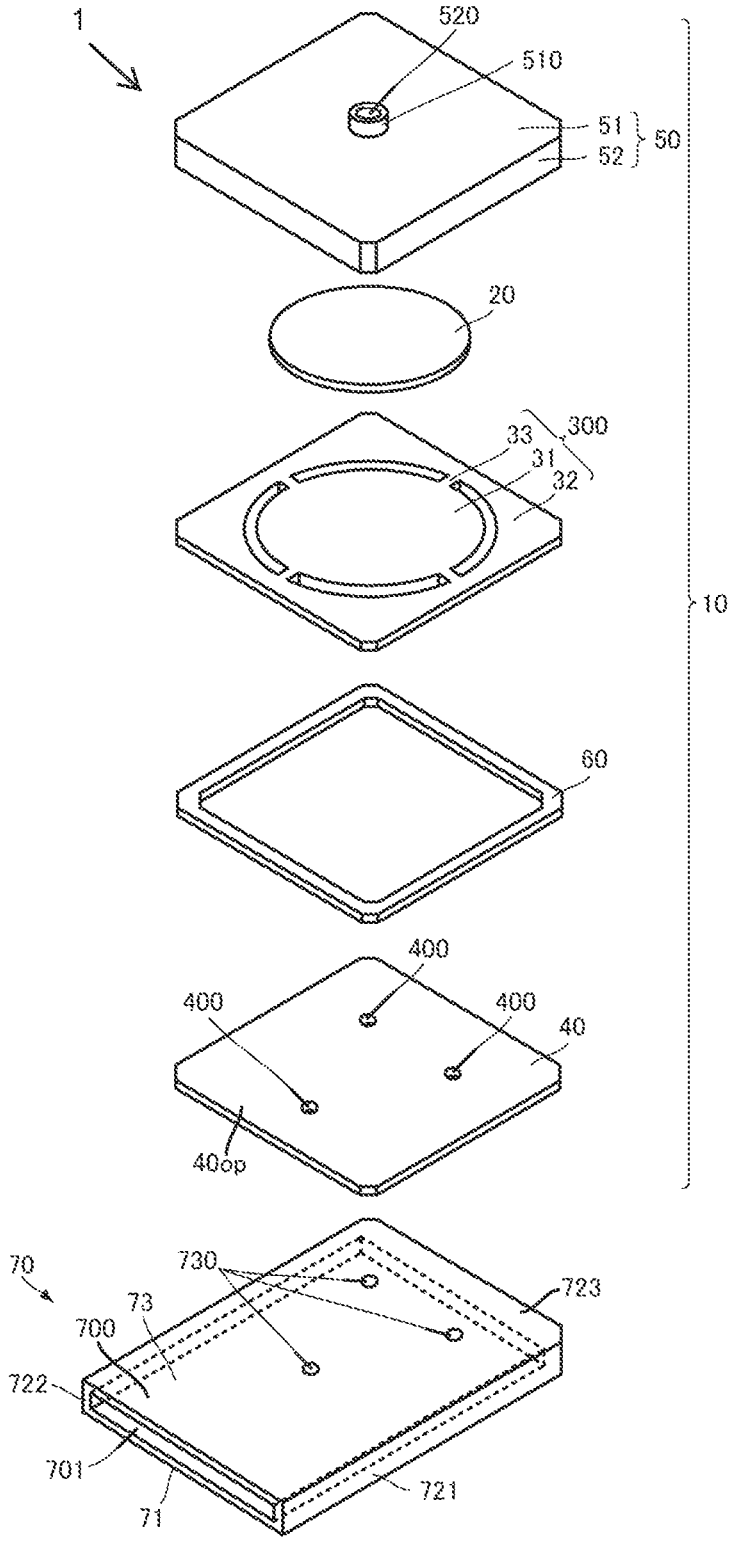
FIG. 2 is an exploded perspective view of the pump device according to the First Embodiment.
Figure 3:
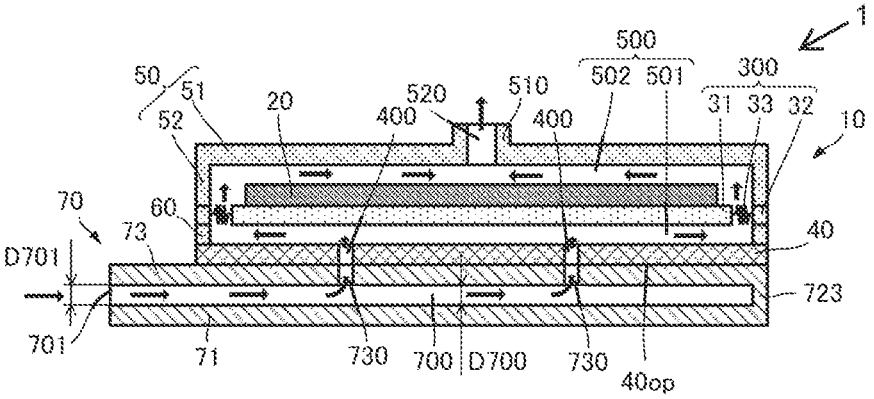
FIG. 3 is a diagram illustrating the outline of the flow of a fluid generated by the pump device according to the First Embodiment.

A pump device according to a First Embodiment of the present disclosure will be described while referring to the drawings. FIG. 1A is a plan view of the pump device according to the First Embodiment. FIG. 1B is a lateral plane sectional view illustrating the configuration of the pump device according to the First Embodiment. FIG. 1C is a side view of the pump device according to the First Embodiment. FIG. 1B is a diagram illustrating a lateral plane in a direction perpendicular to an opening plane of an external inlet, and FIG. 1C is a side view in which the opening plane of the external inlet is viewed from its front. FIG. 2 is an exploded perspective view of the pump device according to the First Embodiment. FIG. 3 is a diagram illustrating the outline of the flow of a fluid generated by the pump device according to the First Embodiment.

In each of the drawings illustrated in the following embodiments, the shapes (dimensions) of the individual constituent elements are partially or completely exaggerated in order to make the description easier to understand.

As illustrated in FIG. 1A, FIG. 1B, FIG. 1C, FIG. 2, and FIG. 3, a pump device 1 includes a piezoelectric pump 10 and an outer casing 70. The outer casing 70 and the piezoelectric pump 10 contact each other at the sides thereof near inlets 400 of the piezoelectric pump 10.

(Configuration of Piezoelectric Pump 10)

The piezoelectric pump 10 includes a piezoelectric element 20, a flat plate member 300 that includes a vibration plate 31, a first casing member 40, a second casing member 50, and a third casing member 60.

The piezoelectric element 20 consists of a piezoelectric disk and driving electrodes. The driving electrodes are formed on both main surfaces of the piezoelectric disk.

The flat plate member 300 includes the vibration plate 31, a base part 32, and a support part 33. The flat plate member 300 is, for example, a flat plate composed of a metal or the like. The shape of the flat plate member 300 in plan view is a rectangular shape. The surfaces seen in plan view are the main surfaces of the flat plate member 300. The flat plate member 300 is realized using a single flat plate, for example. In other words, the vibration plate 31, the base part 32, and the support part 33 are integrally formed as a single flat plate. The vibration plate 31 is a disk. The base part 32 is shaped so as to surround the outer periphery of the vibration plate 31. The support part 33 connects the vibration plate 31 and the base part 32 to each other. Here, the support part 33 connects the vibration plate 31 and the base part 32 to each other in a localized manner at a plurality of places along the outer periphery of the vibration plate 31. With this configuration, the vibration plate 31 is supported so as to be able to vibrate relative to the base part 32.

The first casing member 40 is, for example, a flat plate composed of a metal or the like. The material of the first casing member 40 preferably has prescribed rigidity and thermal conductivity. The first casing member 40 has a substantially rectangular shape in plan view. The surfaces seen in plan view are main surfaces of the first casing member 40. The first casing member 40 has a plurality of inlets 400. When the piezoelectric pump 10 is viewed in plan view, the plurality of inlets 400 overlap the vibration plate 31, for example. The plurality of inlets 400 are through holes that penetrate between the main surfaces of the first casing member 40. The plurality of inlets 400 have, for example, a circular shape in a cross section parallel to the main surfaces of the first casing member 40. The diameter of this circular shape is, for example, 0.8 mm.

The second casing member 50 includes a main plate 51 and a side wall 52 and is shaped like a box. The second casing member 50 is, for example, composed of a metal or the like. The main plate 51 and the side wall 52 are flat plates. More specifically, the shape of the main plate 51 in plan view is a rectangular shape, and the main plate 51 has substantially the same area and shape as the first casing member 40. The side wall 52 extends in a direction perpendicular to the main surfaces of the main plate 51. The side wall 52 is disposed along an outer peripheral edge of the main plate 51. Thus, the second casing member 50 is formed in a box-like shape. A nozzle 510 is formed on the main plate 51. The nozzle 510 has a cylindrical shape. The nozzle 510 is connected to a main surface of the main plate 51 that is on the opposite side from the main surface of the main plate 51 that is near the side wall 52.

The second casing member 50 has an outlet 520. The outlet 520 is a through hole that penetrates through the nozzle 510 and the main plate 51. When the piezoelectric pump 10 is viewed in plan view, the outlet 520 overlaps the vibration plate 31, for example.

The third casing member 60 is a frame having a prescribed thickness. The outer shape of the third casing member 60 is substantially the same as the outer shape of the first casing member 40.

The third casing member 60 is connected to one main surface of the first casing member 40. The base part 32 of the flat plate member 300 is connected to the third casing member 60. The side wall 52 of the second casing member 50 is connected to the base part 32 of the flat plate member 300. With this configuration, a pump casing having an internal space 500 thereinside is realized. The internal space 500 communicates with the space outside the pump casing on the side near the first casing member 40 via the inlets 400. The internal space 500 communicates with the space outside the pump casing on the side near the second casing member 50 via the outlet 520. Furthermore, as illustrated in FIG. 3, the internal space 500 is divided into a first space 501 and a second space 502 by the vibration plate 31. The first space 501 is a space on the side of the vibration plate 31 near the inlets 400 and the second space 502 is the space on the side of the vibration plate 31 near the outlet 520. The first space 501 and the second space 502 communicate with each other via through holes that are provided in the support part 33 and penetrate through the flat plate member 300.

The piezoelectric element 20 is disposed on a main surface of the vibration plate 31 in the second space 502.

With this configuration, the piezoelectric pump 10 transports a fluid as described next. The principles of fluid transport are known from the previous applications of the applicant of the present application and so forth and therefore a simplified description will be given.

The piezoelectric element 20 is connected to a control unit, which is not illustrated. The control unit generates an alternating-current voltage and applies the alternating-current voltage to the piezoelectric element 20. As a result, the piezoelectric element 20 expands and contracts and the vibration plate 31 undergoes bending vibration. Thus, the volumes of the first space 501 and the second space 502 change, and a fluid is sucked into the inside of the piezoelectric pump 10 from the inlets 400 and is discharged to the outside from the outlet 520 as a result of these changes, as illustrated in FIG. 3.

With this configuration, the piezoelectric pump 10 generates heat due to the vibration of the vibration plate 31. The pump device 1 of the disclosure of the present application is able to dissipate heat from the piezoelectric pump 10 as a result of being provided with the outer casing 70 described next.

(Configuration of Outer Casing 70)

As illustrated in FIG. 1A, FIG. 1B, FIG. 1C, FIG. 2, and FIG. 3, the outer casing 70 includes a main flat plate 71, a main flat plate 73, a side wall 721, a side wall 722, and a side wall 723. The main flat plate 71 and the main flat plate 73 are composed of a material having high thermal conductivity. It is sufficient that at least the main flat plate 73 be composed of a material having high thermal conductivity, but it is preferable that the main flat plate 71 also be composed of a material having high thermal conductivity. The main flat plate 71 and the main flat plate 73 are disposed so that the main surfaces thereof face each other and so as to be substantially parallel to each other. The surface of the main flat plate 71 that faces the main flat plate 73 corresponds to "a first main surface of an outer casing" of the present disclosure. Three sides of the outer periphery of the main flat plate 71 and three sides of the outer periphery of the main flat plate 73 are connected to each other by the side wall 721, the side wall 722, and the side wall 723. With this configuration, the outer casing 70 has a box-like shape having an internal space 700.

The outer casing 70 has an external inlet 701. The external inlet 701 is realized by a region in which the main flat plate 71 and the main flat plate 73 are not connected to each other by the side wall 721, the side wall 722, or the side wall 723. In other words, in this embodiment, the external inlet 701 is realized due to the outer casing 70 not being provided with one side wall of the box-like shape. The opening plane of the external inlet 701 has a rectangular shape, for example, as illustrated in FIG. 1C.

The outer casing 70 has a plurality of outlet ports 730. The plurality of outlet ports 730 are through holes that penetrate between the main surfaces of the main flat plate 73. The plurality of outlet ports 730 have, for example, a circular shape in a cross section parallel to the main surfaces of the main flat plate 73. The size of the outlet ports 730 in plan view (looking in direction perpendicular to opening planes) is preferably greater than or equal to the size of the inlets 400. The plurality of outlet ports 730 are disposed in the same pattern as the inlets 400 of the piezoelectric pump 10 described above. The internal space 700 communicates with the space outside the outer casing 70 on the side near the main flat plate 73 via the plurality of outlet ports 730.

(Installation Configuration of Piezoelectric Pump 10 and Outer Casing 70 and Operational Effect of Pump Device 1)

The main flat plate 73 of the outer casing 70 contacts an outer main surface 40*op* of the first casing member 40 of the piezoelectric pump 10. The outer main surface 40*op* of the first casing member 40 is a surface of the first casing member 40 that is on the opposite side from the main surface of the first casing member 40 that face the first space 501 and is a surface that forms an external surface of the piezoelectric pump 10.

At this time, the outer casing 70 and the piezoelectric pump 10 are disposed so that the outlet ports 730 of the outer casing 70 and the inlets 400 of the first casing member 40 overlap (communicate with each other).

In this configuration, as described above, when the piezoelectric pump 10 sucks a fluid in from the inlets 400, the fluid is supplied to the inlets 400 via the external inlet 701, the internal space 700, and the outlet ports 730 of the outer casing 70. In other words, the fluid is transported from the outside of the outer casing 70 to the inside of the internal space 700 of the outer casing 70 via the external inlet 701. The fluid is transported through the inside of the internal space 700 to the outlet ports 730 and the fluid then flows into the inlets 400 from the outlet ports 730. In other words, the internal space 700 is a fluid "transport path" according to the present disclosure.

With the above-described configuration, in the pump device 1, the fluid transport path in the outer casing 70 is parallel to the outer main surface 40*op* of the first casing member 40. Therefore, the fluid flowing along the transport path is able to dissipate heat of the first casing member 40 from the outer main surface 40*op* side. At this time, the transport path faces substantially the entire outer main surface 40*op* of the first casing member 40. Therefore, heat can be dissipated over a large area. Therefore, the heat dissipation effect for the piezoelectric pump 10 is improved by the outer casing 70.

In addition, since the fluid flows along the transport path before being sucked into the piezoelectric pump 10, the fluid flowing along the transport path is at a lower temperature than the fluid inside the piezoelectric pump 10 and the fluid discharged from the outlet 520 to the outside. Therefore, heat is more effectively dissipated from the first casing member 40, i.e., the piezoelectric pump 10 due to the configuration of the pump device 1 being used.

Furthermore, a height D700 of the internal space 700 is preferably short. This allows the speed of fluid transported along the transport path (internal space 700) to be increased. As a result, heat is more effectively dissipated from the first casing member 40, i.e., the piezoelectric pump 10. The lower limit of the height D700 is preferably set so that the maximum amount of fluid transported in the internal space 700 is greater than or equal to the maximum amount of fluid that can be sucked in through the inlets 400, which is determined by the performance of the piezoelectric pump 10. This prevents the shape of the internal space 700 from becoming a rate-limiting factor for the performance of the piezoelectric pump 10. Therefore, heat is effectively dissipated from the piezoelectric pump 10 without reducing the performance of the piezoelectric pump 10.

Furthermore, a height D701 of the external inlet 701 is preferably greater than or equal to the height D700 of the internal space 700. Thus, the amount of fluid supplied to the internal space 700 is not limited by the external inlet 701. Therefore, the shape of the external inlet 701 can be prevented from becoming a rate-limiting factor for the fluid transported in the internal space 700. Although a comparison of the height D701 of the external inlet 701 and the height D700 of the internal space 700 is illustrated here, the shape of the external inlet 701 may be specified using for example an area in a direction perpendicular to the direction in which the fluid is transported.

Figure 4:
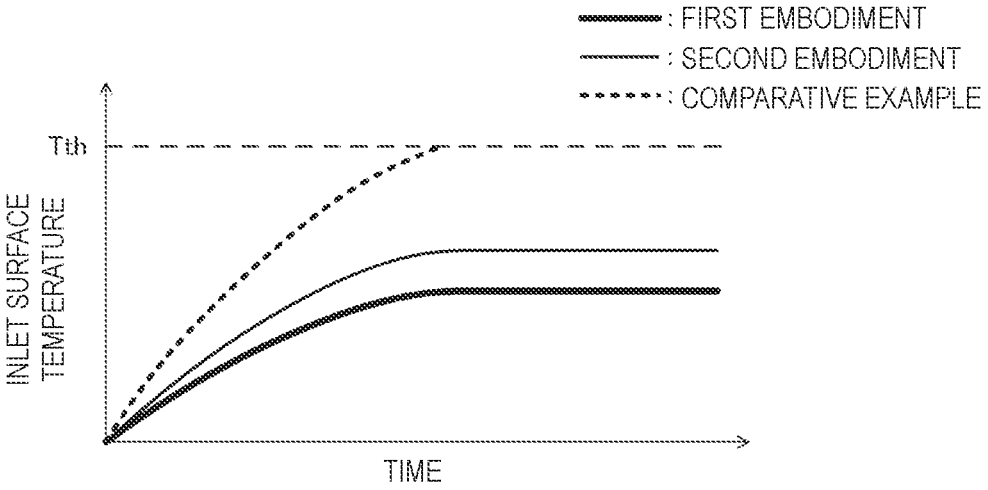
FIG. 4 is a graph illustrating changes over time in an inlet surface temperature for configurations of the present application and a comparative example.

FIG. 4 is a graph illustrating changes over time in an inlet surface temperature for configurations of the present application and a comparative example. In FIG. 4, the horizontal axis represents the elapsed time from the start of driving of the piezoelectric pump 10, and the vertical axis represents the inlet surface temperature of the piezoelectric pump 10, i.e., the temperature of the outer main surface 40*op* of the first casing member 40. The comparative example represents a configuration that does not include a heat dissipating structure like that of the disclosure of the present application.

As illustrated in FIG. 4, the temperature of the inlet surface increases with elapsed time in both the configurations of the present application and the comparative configuration. However, the rate of increase of the temperature can be decreased and the attainable temperature can be made lower by using the configurations of the present application. For example, an upper limit temperature Tth at which driving is stopped in order to prevent a malfunction is set for the piezoelectric pump 10. This upper limit temperature Tth is reached in the comparative example, whereas the upper limit temperature is not reached in the configurations of the present application. Therefore, the piezoelectric pump 10 can be stably driven for a longer time compared with the comparative example of the related art.

In FIG. 4, the characteristics of the pump device 1 according to the First Embodiment and a pump device 1C (refer to FIG. 8) according to a Second Embodiment described later are illustrated. Basically, the pump device 1C according to the Second Embodiment has a configuration in which a side surface of the piezoelectric pump 10 is made to also contact an outer casing 70C. In the piezoelectric pump 10, the area of the outer main surface 40*op* is large and the area of the side surface is smaller than that of the outer main surface 40*op*. When the piezoelectric pump 10 is structured so that the vibration plate 31 and the first casing member 40 are close to each other and the vibration plate 31 and the first casing member 40 move closer to each other due to vibration, heat of the vibration plate 31 is mainly transmitted to the first casing member 40. In this case, as illustrated in FIG. 4, the heat dissipation effect of the first casing member 40 for the same flow rate is improved by using the configuration of the pump device 1 according to the First Embodiment compared with using the configuration of the pump device 1C according to the Second Embodiment. In other words, the heat dissipation effect of the inlet surface for a given flow rate is improved by using the configuration of the pump device 1.

Figure 5A:
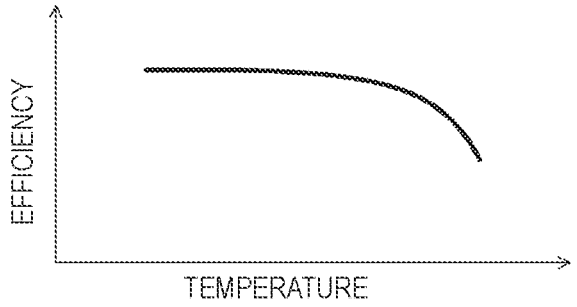
FIG. 5A is a graph illustrating the relationship between the temperature of the piezoelectric pump and the fluid transport efficiency.
Figure 5B:
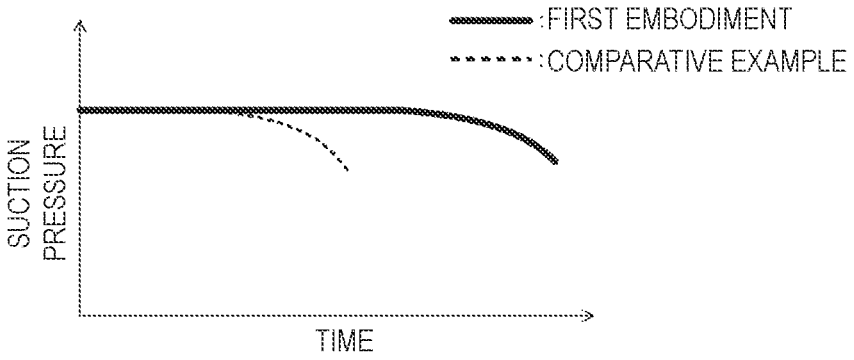
FIG. 5B is a graph illustrating the relationship between elapsed time and suction pressure.

FIG. 5A is a graph illustrating the relationship between the temperature of a piezoelectric pump and the fluid transport efficiency. FIG. 5B is a graph illustrating the relationship between elapsed time and suction pressure. "Suction pressure" refers to the pressure of a suction device that performs suction using a piezoelectric pump.

As illustrated in FIG. 5A, the transport efficiency of the piezoelectric pump falls as the temperature increases. Therefore, as illustrated in FIG. 5B, the start time of the fall in suction pressure can be delayed compared with the comparative example by using the configuration of the piezoelectric pump 10. In other words, a suction device that uses the piezoelectric pump 10 is able to maintain a prescribed suction pressure for a longer time than a suction device that uses the comparative example.

(Modifications of Configuration of Pump Device According to First Embodiment)

Figure 6A:
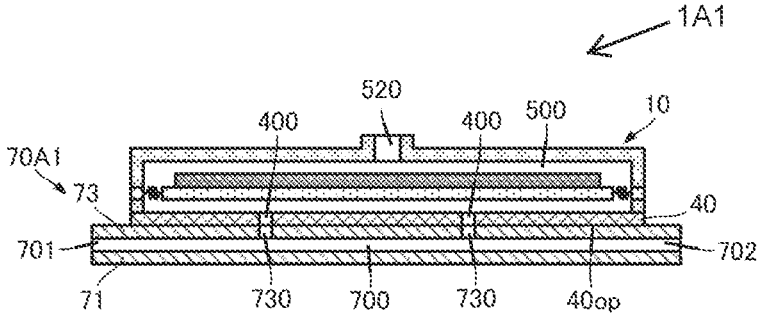
FIG. 6A, FIG. 6B, and FIG. 6C are lateral plane sectional views respectively illustrating a First Modification, a Second Modification, and a Third Modification of the pump device according to the First Embodiment.
Figure 6B:
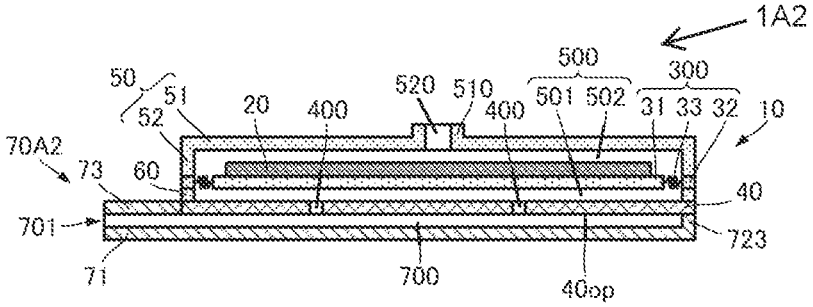
Figure 6C:
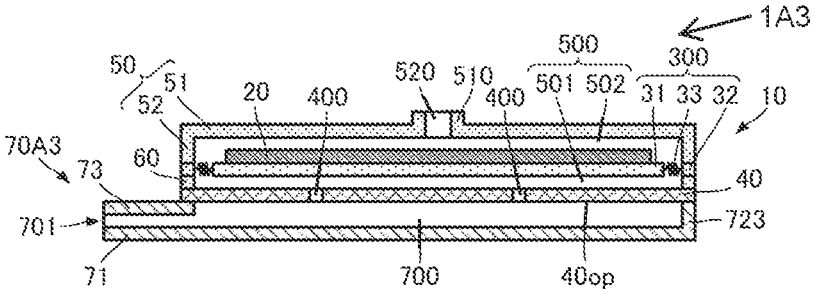
Figure 7:
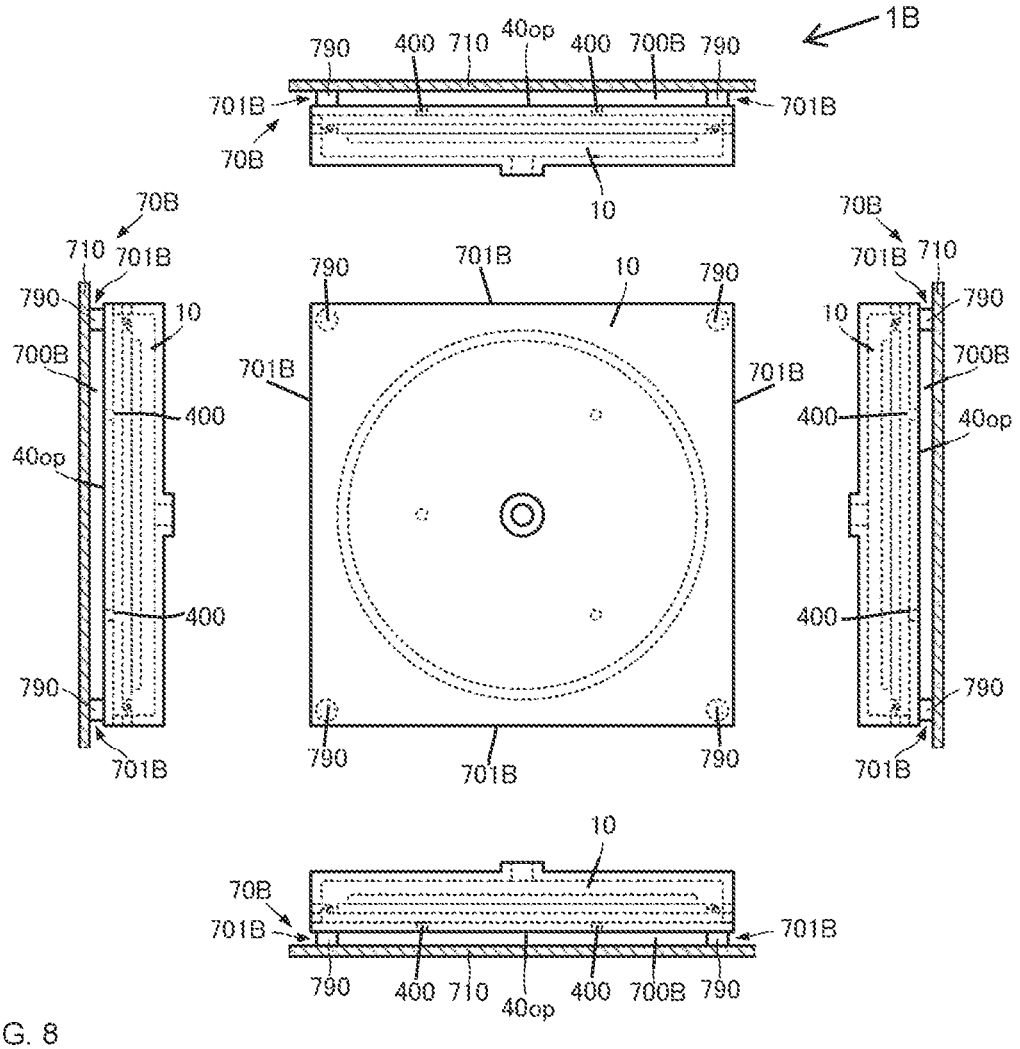
FIG. 7 is a five view diagram illustrating the configuration of a Fourth Modification of the pump device according to the First Embodiment.

FIG. 6A is a lateral plane sectional view illustrating the configuration of a First Modification of the pump device according to the First Embodiment, FIG. 6B is a lateral plane sectional view illustrating the configuration of a Second Modification of the pump device according to the First Embodiment, and FIG. 6C is a lateral plane sectional view illustrating the configuration of a Third Modification of the pump device according to the First Embodiment. FIG. 7 is a five view diagram illustrating the configuration of a Fourth Modification of the pump device according to the First Embodiment.

A pump device 1A1 illustrated in FIG. 6A differs from the pump device 1 described above in terms of the configuration of an outer casing 70A1. The rest of the configuration of the pump device 1A1 is the same as that of the pump device 1 and description of identical parts is omitted.

The outer casing 70A1 differs from the outer casing 70 in that the outer casing 70A1 has an external inlet 702. The external inlet 702 is disposed at a different position from the external inlet 701 in the outer casing 70A1. With this configuration, the outer casing 70A1 has a plurality of external inlets.

With this configuration as well, the pump device 1A1 realizes the same heat dissipation effect as the pump device 1 described above. In addition, as a result of having a plurality of external inlets, the outer casing 70A1 is able to more reliably prevent the external inlets from being a rate-limiting factor for fluid transport.

A pump device 1A2 illustrated in FIG. 6B differs from the pump device 1 described above in terms of the configuration of an outer casing 70A2. The rest of the configuration of the pump device 1A2 is the same as that of the pump device 1 and description of identical parts is omitted.

The outer casing 70A2 has an opening in the main flat plate 73 at a position overlapping the first casing member 40 of the piezoelectric pump 10. The first casing member 40 closes the opening of the main flat plate 73. In other words, the first casing member 40 is exposed at the internal space 700 side of the outer casing 70A2 and constitutes part of a wall forming the internal space 700 of the outer casing 70A2.

Thus, a fluid flowing through the internal space 700, that is, the flow path directly contacts the outer main surface 40*op* of the first casing member 40. Therefore, the heat dissipation effect of the first casing member 40 is improved.

A pump device 1A3 illustrated in FIG. 6C differs from the pump device 1 described above in terms of the configuration of an outer casing 70A3. The rest of the configuration of the pump device 1A3 is the same as that of the pump device 1 and description of identical parts is omitted.

The outer casing 70A3 has an opening in the main flat plate 73 at a position overlapping the first casing member 40 of the piezoelectric pump 10. The area of the opening is smaller than the area of the outer main surface 40*op* of the first casing member 40. With this configuration, the outer main surface 40*op* of the first casing member 40 contacts the main flat plate 73 and the side wall 723 along part of the outer peripheral edge. In this case, part of the first casing member 40 is exposed at the internal space 700 side of the outer casing 70A3 and constitutes part of a wall forming the internal space 700 of the outer casing 70A3.

Thus, a fluid flowing through the internal space 700, that is, the flow path directly contacts the outer main surface 40*op* of the first casing member 40. Therefore, the heat dissipation effect of the first casing member 40 is improved. In addition, in this case, the outer main surface 40*op* of the first casing member 40 contacts the outer casing 70A3 along part of the outer peripheral edge. This makes it easier to attach the first casing member 40 to the outer casing 70A3.

A pump device 1B illustrated in FIG. 7 differs from the pump device 1 described above in terms of the configuration of an outer casing 70B. The rest of the configuration of the pump device 1B is the same as that of the pump device 1 and description of identical parts is omitted.

The outer casing 70B includes a main flat plate 710 and a plurality of cylindrical members 790. The main flat plate 710 is disposed so as to be spaced apart from and parallel to the outer main surface 40*op* of the first casing member 40 of the piezoelectric pump 10. The main flat plate 710 and the first casing member 40 are connected to each other by the plurality of cylindrical members 790.

In this configuration, a space 700B between the first casing member 40 and the main flat plate 710 forms a flow path. The part of the space 700B that is flush with the side surface of the piezoelectric pump 10 forms an external inlet 701B. With this configuration as well, the pump device 1B realizes the same heat dissipation effect as the pump device 1 described above. Furthermore, in this configuration, the outer main surface 40*op* of the first casing member 40 of the piezoelectric pump 10 forms a wall surface of the flow path. Therefore, the heat dissipation effect is improved. In addition, in this configuration, the configuration of the outer casing 70B can be simplified. In this configuration, the main flat plate 710 can be realized by an outer wall of a device in which the piezoelectric pump 10 is installed. Therefore, the above-described heat dissipation effect can be obtained by just installing the piezoelectric pump 10 in the device.

Second Embodiment

Figure 8:
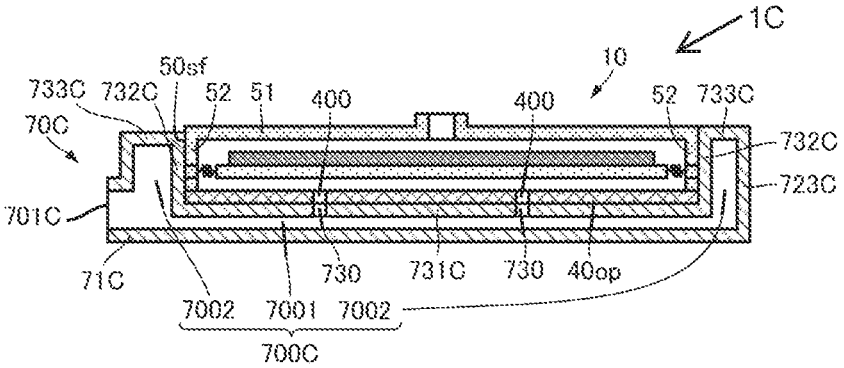
FIG. 8 is a lateral plane sectional view illustrating the configuration of a pump device according to a Second Embodiment.

A pump device according to a Second Embodiment will be described while referring to the drawings. FIG. 8 is a lateral plane sectional view illustrating the configuration of the pump device according to the Second Embodiment.

As illustrated in FIG. 8, the pump device 1C according to the Second Embodiment differs from the pump device 1 according to the First Embodiment in terms of the configuration of an outer casing 70C. The rest of the configuration of the pump device 1C is the same as that of the pump device 1 and description of identical parts is omitted.

The outer casing 70C differs from the outer casing 70 in terms of the shape of a main plate on the side near the piezoelectric pump 10. The shape of a main flat plate 71C is the same as that of the main flat plate 71, and the shape of a side wall 723C is a shape obtained by changing the shape of the side wall 723 in accordance with the shape of a main plate on the side near the piezoelectric pump 10. In addition, side walls that are not illustrated also have shapes obtained by changing the shapes of the side wall 721 and the side wall 722 described above in accordance with the shape of the main plate on the side near the piezoelectric pump 10.

The main plate on the side near the piezoelectric pump 10 includes a first flat plate part 731C, a second flat plate part 732C, and a third flat plate part 733C. The first flat plate part 731C contacts the outer main surface 40*op* of the first casing member 40. The second flat plate part 732C contacts an outer surface 50*sf* of the pump casing. The third flat plate part 733C is connected to an end portion of the second flat plate part 732C that is on the opposite side from the end portion connected to the first flat plate part 731C. The third flat plate part 733C is parallel to and faces the main flat plate 71C.

With this configuration, an internal space 700C of the outer casing 70C includes a first space 7001 and a second space 7002. The space consisting of the first space 7001 and the second space 7002 corresponds to a "flow path" of the present disclosure.

The first space 7001 extends along the outer main surface 40*op* of the first casing member 40, and the second space 7002 extends along the outer surface 50*sf* of the pump casing. With this configuration, heat is dissipated from the piezoelectric pump 10 via the outer main surface 40*op* of the first casing member 40 and the outer surface 50*sf* of the pump casing. Therefore, the pump device 1C can dissipate heat from the piezoelectric pump 10 as with the pump device 1.

Figure 9A:
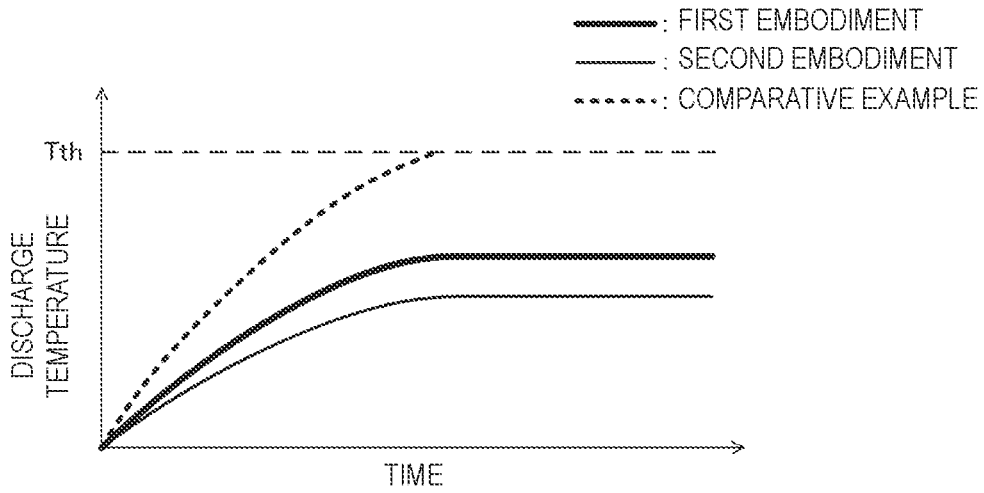
FIG. 9A is a graph illustrating changes over time in a discharge temperature for configurations of the present application and a comparative example.
Figure 9B:
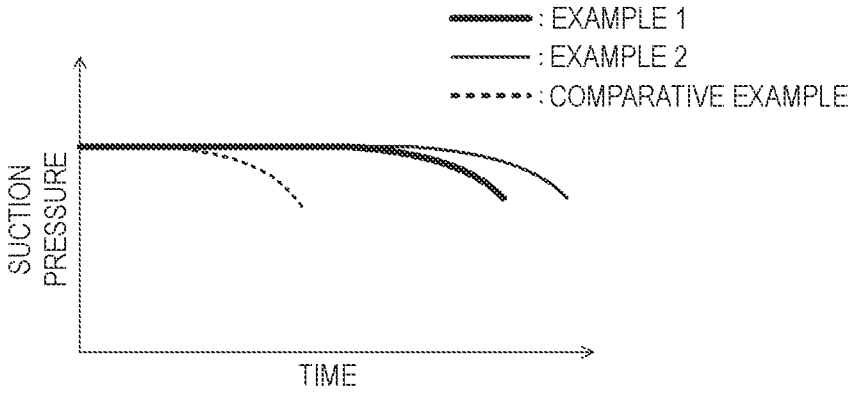
FIG. 9B is a graph illustrating the relationship between elapsed time and suction pressure.

FIG. 9A is a graph illustrating changes over time in a discharge temperature for configurations of the present application and a comparative example. In FIG. 9A, the horizontal axis represents elapsed time from the start of driving of the piezoelectric pump 10, and the vertical axis represents the discharge temperature of the piezoelectric pump 10, i.e., the temperature of the outlet 520 of the piezoelectric pump 10. The comparative example represents a configuration that does not include a heat dissipating structure like that of the disclosure of the present application. FIG. 9B is a graph illustrating the relationship between elapsed time and suction pressure.

As illustrated in FIG. 9A, the configuration of the pump device 1C reduces the rate of increase of the discharge temperature and reduces the attainable temperature compared with the comparative example. Together with this, as illustrated in FIG. 9B, a prescribed suction pressure can be maintained for a longer time with the configuration of the pump device 1C compared with the comparative example.

Furthermore, by adopting the configuration of the pump device 1C, the rate of increase of the discharge temperature is reduced and the attainable temperature is reduced compared with the pump device 1 according to the First Embodiment. Together with this, as illustrated in FIG. 9B, a prescribed suction pressure can be maintained for a longer time with the configuration of the pump device 1C compared with the pump device 1.

In addition, with this configuration, as illustrated in FIG. 8, the height of an external inlet 701C can be made larger than the height of the first space 7001 that communicates with the outlet ports 730. This allows the external inlet 701C to be prevented from becoming a rate-limiting factor for fluid transport.

Third Embodiment

Figure 10A:
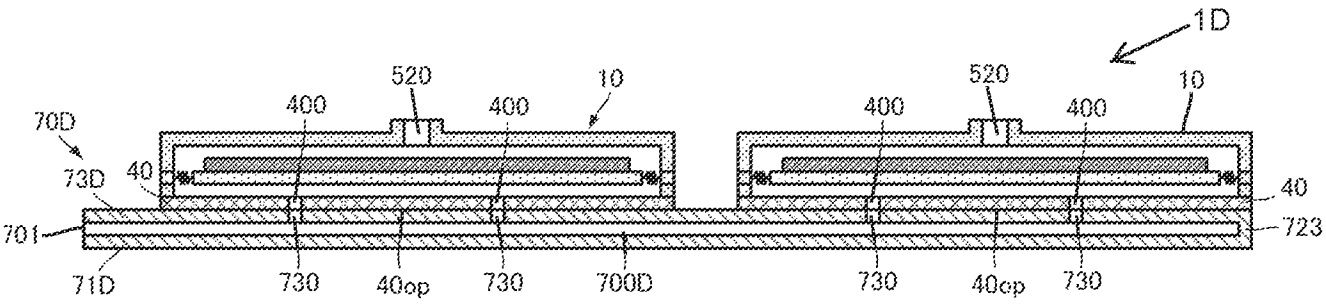
FIG. 10A is a lateral plane sectional view illustrating the configuration of a pump device according to a Third Embodiment.
Figure 10B:
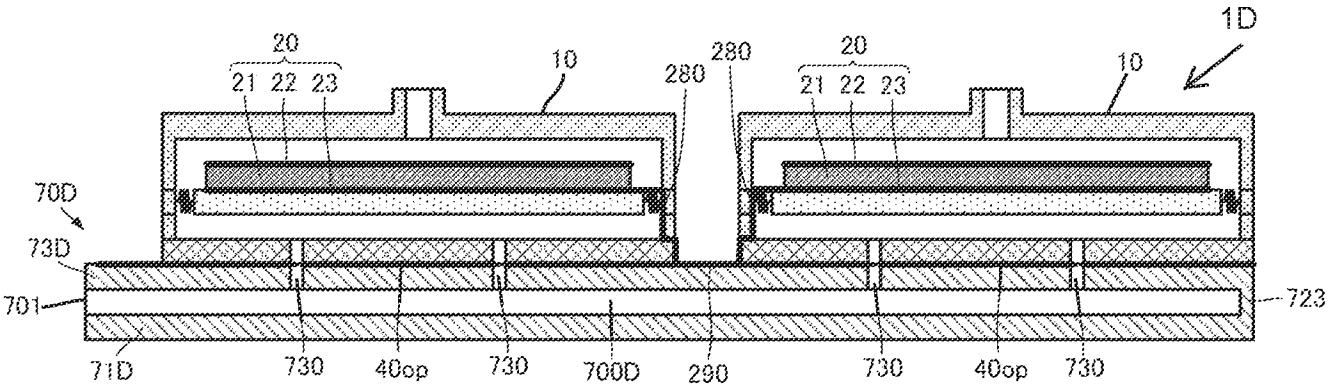
FIG. 10B is a lateral plane sectional view illustrating an example of wiring for the pump device according to the Third Embodiment.

A pump device according to a Third Embodiment will be described while referring to the drawings. FIG. 10A is a lateral plane sectional view illustrating the configuration of the pump device according to the Third Embodiment. FIG. 10B is a lateral plane sectional view illustrating an example of wiring for the pump device according to the Third Embodiment.

As illustrated in FIGS. 10A and 10B, a pump device 1D according to the Third Embodiment differs from the pump device 1 according to the First Embodiment in that the pump device 1D includes a plurality of piezoelectric pumps 10. The rest of the configuration of the pump device 1D is the same as that of the pump device 1 and description of identical parts is omitted.

The pump device 1D includes a plurality of piezoelectric pumps 10 and an outer casing 70D. The outer casing 70D includes a main flat plate 71D and a main flat plate 73D, and has an internal space 700D. The main flat plate 71D and the main flat plate 73D are shaped so as to allow the plurality of piezoelectric pumps 10 to be disposed side by side.

The plurality of piezoelectric pumps 10 are disposed so that the outer main surfaces 40*op* thereof are aligned and contact the main flat plate 73D. The main flat plate 73D has outlet ports 730 for each of the plurality of piezoelectric pumps 10. The plurality of outlet ports 730 respectively communicate with the plurality of inlets 400 of the plurality of piezoelectric pumps 10.

Here, the plurality of piezoelectric pumps 10 are disposed so as to be disposed with increasing distance from the external inlet 701 in a direction parallel to the main surfaces of the main flat plate 73D. Thus, the plurality of piezoelectric pumps 10 are disposed side by side in a direction in which the fluid is transported along the flow path.

Figure 11:
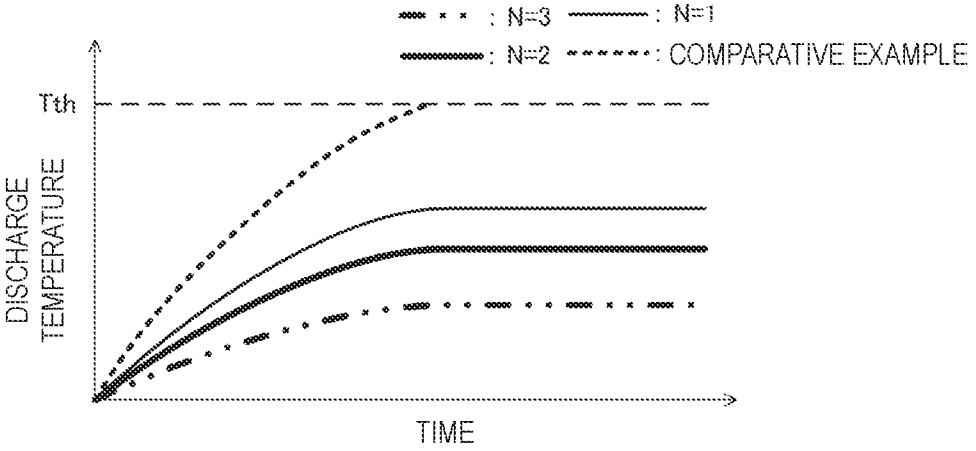
FIG. 11 is a graph illustrating changes over time in a discharge temperature for configurations of the present application and a comparative example.

FIG. 11 is a graph illustrating changes over time in a discharge temperature for configurations of the present application and a comparative example. In FIG. 11, N is the number of piezoelectric pumps 10. As illustrated in FIG. 11, the rate of increase of the discharge temperature and the attainable discharge temperature are reduced by disposing a plurality of piezoelectric pumps 10 compared with a configuration in which only one piezoelectric pump 10 is disposed. In addition, the effect of reducing the rate of increase of the discharge temperature and the effect of reducing the attainable temperature can be improved by increasing the number of piezoelectric pumps 10 that are disposed.

In addition, as illustrated in FIG. 10B, in the pump device 1D, wiring electrodes are provided for the piezoelectric elements 20 of the plurality of piezoelectric pumps 10 in a shared manner. Specifically, the piezoelectric elements 20 are each provided with a piezoelectric element 21, a first electrode 22, and a second electrode 23. The first electrode 22 and the second electrode 23 are disposed with the piezoelectric element 21 interposed therebetween. The piezoelectric element 20 is disposed on the vibration plate 31 so that the second electrode 23 contacts the vibration plate 31.

The outer casing 70D is provided with a shared electrode 290 on an outer main surface of the main flat plate 73D. The second electrodes 23 are connected to the shared electrode 290 via wiring electrodes 280 formed in the pump casings or the like. With this configuration, wiring for carrying out driving in the pump device 1D can be simplified even when a plurality of piezoelectric pumps 10 are provided.

Fourth Embodiment

Figure 12:
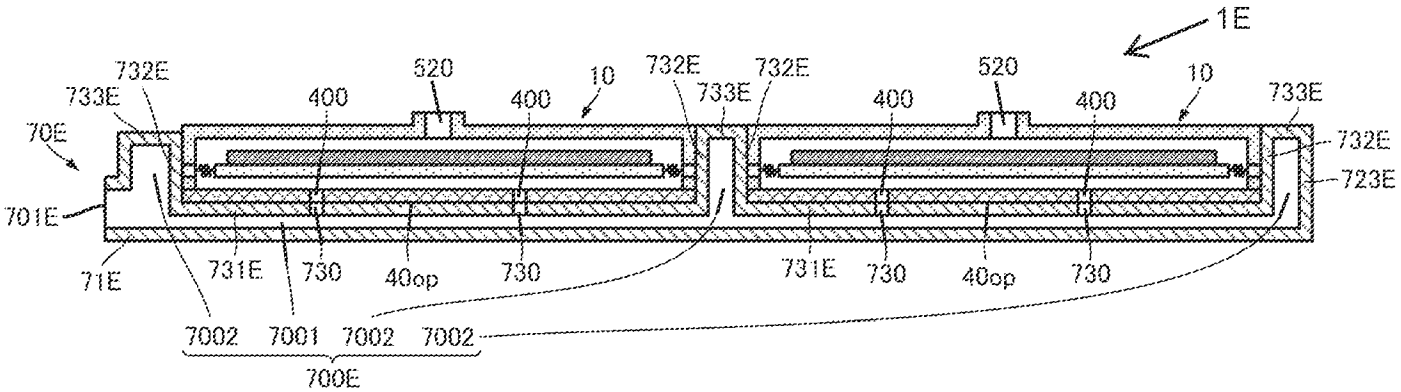
FIG. 12 is a lateral plane sectional view illustrating the configuration of a pump device according to a Fourth Embodiment.

A pump device according to a Fourth Embodiment will be described while referring to the drawings. FIG. 12 is a lateral plane sectional view illustrating the configuration of the pump device according to the Fourth Embodiment.

As illustrated in FIG. 12, a pump device 1E according to the Fourth Embodiment differs from the pump device 1D according to the Third Embodiment in terms of the configuration of an outer casing 70E. The rest of the configuration of the pump device 1E is the same as that of the pump device 1D and description of identical parts is omitted.

The pump device 1E is formed by applying the shape of the outer casing of the pump device 1C illustrated in FIG. 8 to the configuration of the pump device 1D illustrated in FIGS. 10A and 10B. In other words, the outer casing 70E of the pump device 1E includes a main flat plate 71E, first flat plate parts 731E, second flat plate parts 732E, and third flat plate parts 733E. A side wall 723E has the same configuration as the side wall 723C described above. The plurality of first flat plate parts 731E respectively contact the outer main surfaces 40*op* of the plurality of piezoelectric pumps 10. The plurality of second flat plate parts 732E respectively contact the outer surfaces 50*sf* of the pump casings of the plurality of piezoelectric pumps 10. The plurality of third flat plate parts 733E are respectively connected to the plurality of second flat plate parts 732E. With this configuration, the outer casing 70E has an internal space 700E. The internal space 700E includes a first space 7001 and a plurality of second spaces 7002. The first space 7001 is a space that is parallel to the outer main surfaces 40*op* of the first casing members 40 of the plurality of piezoelectric pumps 10. The second spaces 7002 are spaces that are parallel to the outer surfaces 50*sf* of the pump casings of the plurality of piezoelectric pumps 10. The internal space 700E communicates with the space outside the outer casing 70E via an external inlet 701E.

With this configuration as well, the pump device 1E realizes the same heat dissipation effect as the pump device 1D. In addition, since heat is dissipated from the side walls of the plurality of piezoelectric pumps 10, a higher heat dissipation effect is obtained.

Fifth Embodiment

Figure 13A:
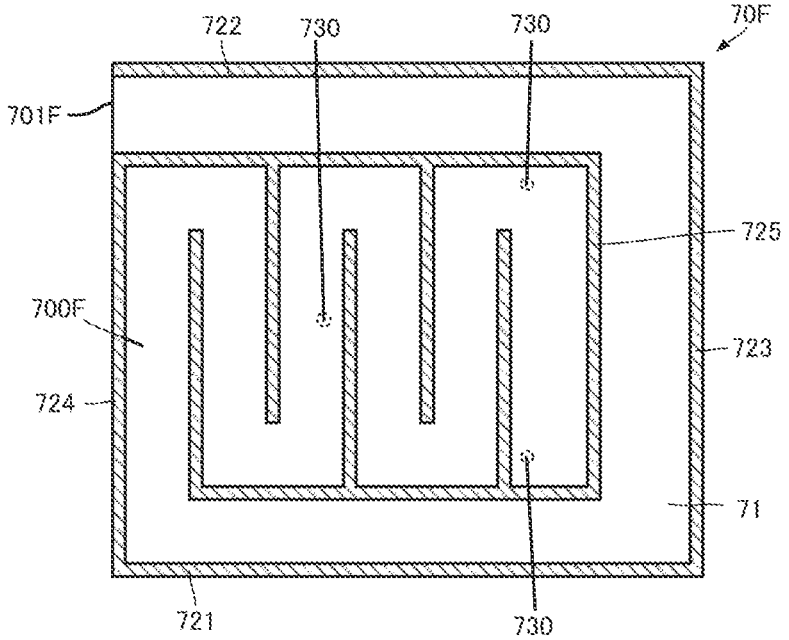
FIG. 13A and FIG. 13B are plan sectional views illustrating the configurations of outer casings of pump devices according to a Fifth Embodiment.
Figure 13B:
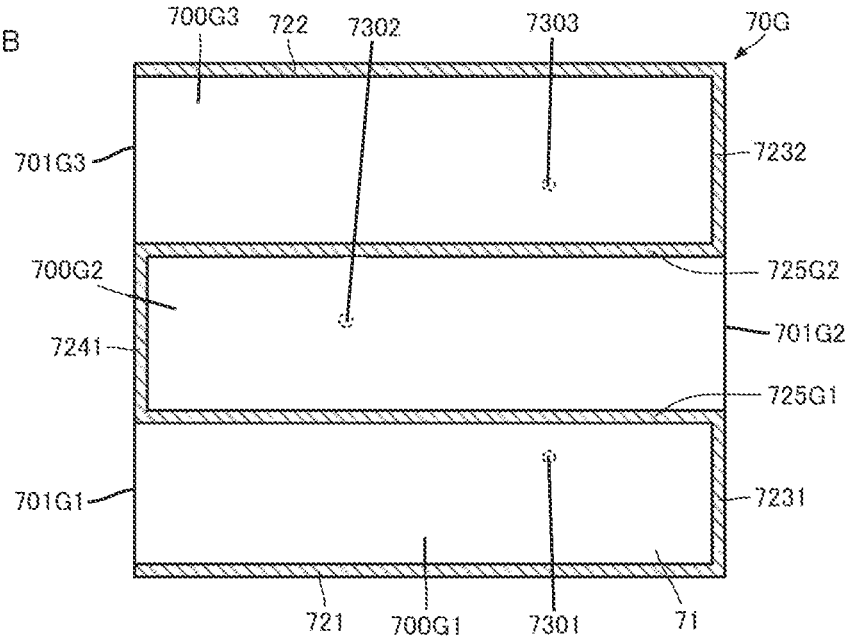

Pump devices according to a Fifth Embodiment will be described while referring to the drawings. FIG. 13A and FIG. 13B are plan sectional views illustrating the configurations of outer casings of the pump devices according to the Fifth Embodiment. The pump devices according to the Fifth Embodiment differ from the pump devices according to the other embodiments in terms of the structure of the outer casing. The rest of the configurations of the pump devices according to the Fifth Embodiment is the same as that of the other embodiments and description of identical parts is omitted.

An outer casing 70F of the pump device illustrated in FIG. 13A includes a side wall 721, a side wall 722, a side wall 723, a side wall 724, and a partition wall 725. The side wall 721, the side wall 722, the side wall 723, the side wall 724, and the partition wall 725 are connected to the main flat plate 71 and are shaped so as to extend in a direction perpendicular to the main surfaces of the main flat plate 71. Although not illustrated, the side wall 721, the side wall 722, the side wall 723, the side wall 724, and the partition wall 725 are connected to the main flat plate 73, which faces the main flat plate 71.

The side wall 721, the side wall 722, the side wall 723, and the side wall 724 are respectively formed so as to extend along the sides forming the outer periphery of the main flat plate 71. The side wall 721 and the side wall 722 face each other and the side wall 723 and the side wall 724 face each other. The side wall 723 is connected to the side wall 721 and the side wall 722. The side wall 724 is connected to the side wall 721 and is not connected to the side wall 722, and there is a gap between the side wall 724 and the side wall 722. This gap serves as an external inlet 701F.

The partition wall 725 is connected to an end portion of the side wall 724 on the side near the side wall 722 and partitions an internal space 700F into winding and meandering shaped spaces. Thus, the fluid flow path has a shape formed by a cylindrical flow path having a winding shape and a cylindrical flow path having a meandering shape being connected to each other. The inlet of this flow path is the external inlet 701F, and a plurality of outlet ports 730 are disposed in the middle of the flow path.

With this configuration, in the outer casing 70F, the flow rate of the fluid flowing along the flow path can be increased. Thus, the heat dissipation effect for the piezoelectric pump 10 is improved. Furthermore, the side wall 721, the side wall 722, the side wall 723, the side wall 724, and the partition wall 725 are formed of a material having high thermal conductivity such as a metal. Thus, the side wall 721, the side wall 722, the side wall 723, the side wall 724, and the partition wall 725 act as a heat sink. Therefore, the heat dissipation effect for the piezoelectric pump 10 is further improved. In particular, the partition wall 725 is disposed lengthwise along the flow path and therefore more effectively acts as a heat sink. Therefore, the heat dissipation effect for the piezoelectric pump 10 is further improved.

Figure 14:
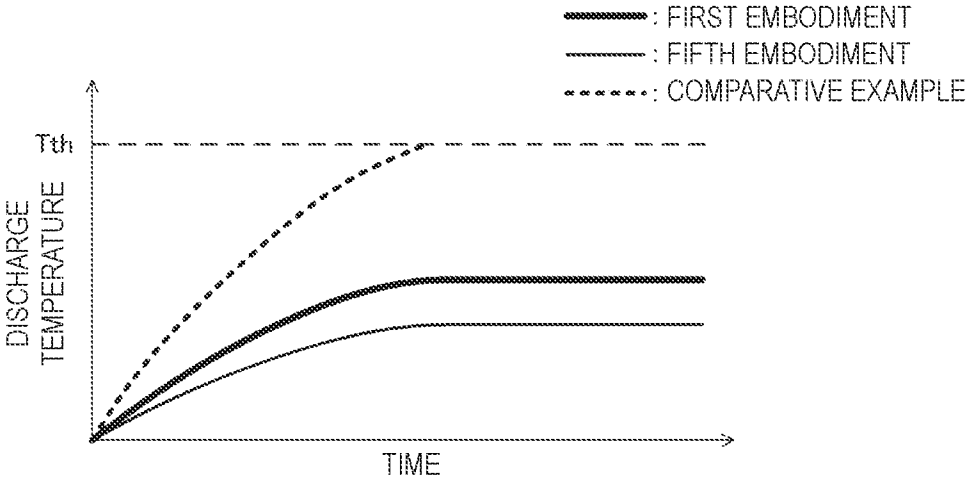
FIG. 14 is a graph illustrating changes over time in a discharge temperature for configurations of the present application and a comparative example.

FIG. 14 is a graph illustrating changes over time in a discharge temperature for configurations of the present application and a comparative example. In FIG. 14, the horizontal axis represents elapsed time from the start of driving of the piezoelectric pump 10, and the vertical axis represents the discharge temperature of the piezoelectric pump 10, i.e., the temperature of the outlet 520 of the piezoelectric pump 10. The comparative example represents a configuration that does not include a heat dissipating structure like that of the disclosure of the present application. In addition, the characteristics of the configuration of the First Embodiment are also illustrated for the comparison of the superiority of the heat sink.

As illustrated in FIG. 14, the rate of increase of the discharge temperature and the attainable temperature are reduced by adopting the configuration of the Fifth Embodiment. In other words, the heat dissipation effect is improved compared to the comparative configuration and a configuration that does not include a heat sink.

In FIG. 13A, the partition wall 725 has a winding shape and a spiral shape. However, the shape of the partition wall 725 is not limited to these shapes, and can be a winding shape, a spiral shape, or any other shape that allows a plurality of outlet ports 730 to be disposed along the middle of the flow path and can form a cylindrical shape.

An outer casing 70G of a pump device illustrated in FIG. 13B includes a side wall 721, a side wall 722, a side wall 7231, a side wall 7232, a side wall 7241, a partition wall 725G1, and a partition wall 725G2. The side wall 721, the side wall 722, the side wall 7231, the side wall 7232, the side wall 7241, the partition wall 725G1, and the partition wall 725G2 are connected to the main flat plate 71 and are shaped so as to extend in a direction perpendicular to the main surfaces of the main flat plate 71. Although not illustrated, the side wall 721, the side wall 722, the side wall 7231, the side wall 7232, the side wall 7241, the partition wall 725G1, and the partition wall 725G2 are connected to the main flat plate 73, which faces the main flat plate 71.

The side wall 721, the side wall 722, the side wall 7231, the side wall 7232, and the side wall 7241 are respectively formed so as to extend along the sides forming the outer periphery of the main flat plate 71. The side wall 721 and the side wall 722 face each other. The side wall 7231 and the side wall 7232 are located on the same side of the main flat plate 71. The side wall 7241 is located on the side opposite from the side where the side wall 7231 and the side wall 7232 are disposed.

The partition wall 725G1 and the partition wall 725G2 are disposed between the side wall 721 and the side wall 722 so as to be parallel to the side wall 721 and the side wall 722. The partition wall 725G1 is disposed so as to be nearer the side wall 721 than the partition wall 725G2 is.

The side wall 721 is connected to the side wall 7231, and the side wall 7231 is connected to the partition wall 725G1. The partition wall 725G1 is connected to the side wall 7241, and the side wall 7241 is connected to the partition wall 725G2. The partition wall 725G2 is connected to the side wall 7232, and the side wall 7232 is connected to the side wall 722.

With this configuration, an internal space 700G1, which is enclosed in a side surface direction, is formed by the side wall 721, the side wall 7231, and the partition wall 725G1. The internal space 700G1 communicates with the outside through an external inlet 701G1 formed by a gap between the side wall 721 and the side wall 7241. An outlet port 7301 communicates with the internal space 700G1.

In addition, an internal space 700G2, which is enclosed in a side surface direction, is formed by the partition wall 725G1, the side wall 7241, and the partition wall 725G2. The internal space 700G2 communicates with the outside through an external inlet 701G2 formed by a gap between the side wall 7231 and the side wall 7232. An outlet port 7302 communicates with the internal space 700G2.

In addition, an internal space 700G3, which is enclosed in a side surface direction, is formed by the partition wall 725G2, the side wall 7232, and the side wall 722. The internal space 700G3 communicates with the outside through an external inlet 701G3 formed by a gap between the side wall 7241 and the side wall 722. An outlet port 7303 communicates with the internal space 700G3.

By adopting this configuration, flow paths can be individually formed for the outlet port 7301, the outlet port 7302, and the outlet port 7303. In addition, in this configuration, the side wall 721, the side wall 722, the side wall 7231, the side wall 7232, the side wall 7241, the partition wall 725G1, and the partition wall 725G2, therefore, further improve the heat dissipation effect for the piezoelectric pump 10. In particular, the heat dissipation effect for the piezoelectric pump 10 is further improved due to the partition wall 725G1 and the partition wall 725G2 being provided.

The configuration of the partition walls is not limited to this configuration, and it is sufficient that at least one partition wall having high thermal conductivity be provided.

In addition, the configurations of the above-described embodiments can be combined as appropriate and operational effects of those combinations can be obtained.

1, 1A1, 1A2, 1A3, 1B, 1C, 1D, 1E: pump device
10: piezoelectric pump
20: piezoelectric element
21: piezoelectric body
22: first electrode
23: second electrode
31: vibration plate
32: base part
33: support part
40: first casing member
40*op*: outer main surface
50: second casing member
50*sf*: outer surface
51: main plate
52: side wall
60: third casing member
70, 70A1, 70A2, 70A3, 70B, 70C, 70D, 70E, 70F, 70G: outer casing
71, 71C, 71D, 71E, 73, 73D: main flat plate
280: wiring electrode
290: shared electrode
300: flat plate member
400: inlet
500: internal space
501: first space
502: second space
510: nozzle
520: outlet
700, 700C, 700D, 700E, 700F, 700G1, 700G2, 700G3: internal space
701, 701B, 701C, 701E, 701F, 701G1, 701G2, 701G3, 702: external inlet
710: main flat plate
721, 722, 723, 723C, 723E, 724, 7231, 7232, 7241: side wall
725, 725G1, 725G2: partition wall

730: outlet port
731C, 731E: first flat plate part
732C, 732E: second flat plate part
733C, 733E: third flat plate part
790: cylindrical member
7001: first space
7002: second space
7301, 7302, 7303: outlet port

The invention claimed is:

1. A pump device comprising:

a piezoelectric pump including:

a first casing member, a second casing member, a plate member having a base part, a vibration plate, a support part that connects the base part to the vibration plate, and a plurality of through holes defined by and adjacent to the base part, support part, and vibration plate, and a piezoelectric element disposed on the vibration plate, wherein the first casing member, second casing member, and plate member form a pump casing having an inlet, an outlet, and an outer main surface having the inlet provided, wherein the vibration plate of the plate member is disposed inside the pump casing and divides an interior of the pump casing into a first portion on a side near the inlet and a second portion on a side near the outlet;

and an outer casing including a first main plate and a second main plate defining a space therebetween, the space allowing communication between an external inlet and the inlet of the pump casing, wherein the external inlet communicates with an outside, wherein the first main plate of the outer casing defines a first main surface that faces the outer main surface of the pump casing having the inlet provided, wherein the second main plate of the outer casing faces and abuts the outer main surface of the pump casing, and defines an outlet port that is aligned with the inlet of the piezoelectric pump, wherein the space extends at least directly between the outer main surface of the pump casing and the first main surface of the outer casing, and wherein the space extends directly between an external surface of the pump casing different from the outer main surface and a surface of the outer casing different from the first main surface.

2. The pump device according to claim 1, wherein the outer main surface or a surface contacting the outer main surface is one wall surface providing the space.

3. The pump device according to claim 1, wherein the space is comprised of only a part facing the outer main surface.

4. The pump device according to claim 1, wherein the external surface of the pump casing is an outer surface of the pump casing.

5. The pump device according to claim 1, wherein a length of the external inlet in a direction perpendicular to the outer main surface is greater than or equal to a length of the space in the direction perpendicular to the outer main surface.

6. The pump device according to claim 1, wherein a plurality of the piezoelectric pumps are disposed, and the plurality of piezoelectric pumps are disposed side by side so that the outer main surfaces of the plurality of piezoelectric pumps are flush with the outer casing.

7. The pump device according to claim 1, wherein a wall of the pump casing having the inlet provided is composed of metal.

8. The pump device according to claim 1, wherein the outer casing includes, within an interior of the outer casing, a partition wall that partitions the interior and defines a shape of the space.

9. The pump device according to claim 1, wherein the external inlet includes a plurality of external inlets, and the outer casing includes the plurality of external inlets.

10. The pump device according to claim 1, wherein a wall of the pump casing having the outer main surface having the inlet provided is a part of a wall providing the space, and the outer main surface is exposed to the space.

11. The pump device according to claim 2, wherein the outer main surface or a surface contacting the outer main surface is one wall surface providing the space.

12. The pump device according to claim 2, wherein a length of the external inlet in a direction perpendicular to the outer main surface is greater than or equal to a length of the space in a direction perpendicular to the outer main surface.

13. The pump device according to claim 3, wherein a length of the external inlet in a direction perpendicular to the outer main surface is greater than or equal to a length of the space in the direction perpendicular to the outer main surface.

14. The pump device according to claim 4, wherein a length of the external inlet in a direction perpendicular to the outer main surface is greater than or equal to a length of the space in the direction perpendicular to the outer main surface.

15. The pump device according to claim 2, wherein a plurality of the piezoelectric pumps are disposed, and the plurality of piezoelectric pumps are disposed side by side so that the outer main surfaces of the plurality of piezoelectric pumps are flush with the outer casing.

16. The pump device according to claim 3, wherein a plurality of the piezoelectric pumps are disposed, and the plurality of piezoelectric pumps are disposed side by side so that the outer main surfaces of the plurality of piezoelectric pumps are flush with the outer casing.

17. The pump device according to claim 1, wherein the space extends along an entire length of the piezoelectric pump.

18. The pump device according to claim 1, wherein the space extends directly between the pump casing and outer casing.

19. The pump device according to claim 1, wherein the piezoelectric element of the piezoelectric pump includes an electrode, and the pump device includes another electrode provided on an outer main surface of the outer casing that is connected to the electrode of the piezoelectric element.

20. The pump device according to claim 1, wherein the pump casing includes a lower wall that defines the inlet, an upper wall that defines the outlet, and a side wall that extends between and connects the upper wall and lower wall, wherein the external surface of the pump casing is an outer surface of the side wall.

21. The pump device according to claim 20, wherein the outer casing directly contacts the outer surface of the side wall of the pump casing.

22. The pump device according to claim 6, wherein the piezoelectric elements of the piezoelectric pumps each include an electrode, and the pump device includes a shared electrode provided on an outer main surface of the outer casing that is connected to the electrodes of the piezoelectric pumps.

23. The pump device according to claim 1, wherein the second main plate opposes the first main plate.

24. A pump device comprising:

a piezoelectric pump including:

a first casing member, a second casing member, a plate member having a base part, a vibration plate, a support part that connects the base part to the vibration plate, and a plurality of through holes defined by and adjacent to the base part, support part, and vibration plate, and a piezoelectric element disposed on the vibration plate, wherein the first casing member, second casing member, and plate member form a pump casing having:

a lower wall that defines an inlet and an outer main surface of the pump casing, an upper wall that defines an outlet, and a side wall that extends between and connects the upper wall and lower wall, the side wall defining an external surface of the pump casing different from the outer main surface, wherein the vibration plate of the plate member is disposed inside the pump casing and divides an interior of the pump casing into a first portion on a side near the inlet and a second portion on a side near the outlet;

and an outer casing providing a space allowing communication between an external inlet and the inlet of the pump casing, wherein the external inlet communicates with an outside, wherein a first main surface of the outer casing faces the outer main surface of the pump casing, wherein the space extends at least directly between the outer main surface of the pump casing and the first main surface of the outer casing, and wherein the space provides a path for fluid to flow in a direction from the external inlet of the outer casing toward the inlet of the pump casing, wherein the direction is parallel to the outer main surface of the pump casing, wherein the space extends directly between the external surface of the pump casing and a surface of the outer casing different from the first main surface.

* * * * *